United States Patent [19]

Bassino

[11] Patent Number: 4,857,872

[45] Date of Patent: Aug. 15, 1989

[54] RELAY

[75] Inventor: Walter Bassino, Sao Paulo, Brazil

[73] Assignee: Uninorm Anstalt, Vaduz, Austria

[21] Appl. No.: 26,520

[22] Filed: Mar. 17, 1987

[30] Foreign Application Priority Data

Mar. 24, 1986 [AT] Austria ..... 782/86

[51] Int. Cl.[4] ..... H01H 51/22

[52] U.S. Cl. ..... 335/80; 335/83

[58] Field of Search ..... 335/78, 80, 81, 83, 335/128, 130, 131, 132, 133, 192

[56] References Cited

U.S. PATENT DOCUMENTS 4,267,540 5/1981 Iketani ..... 335/128
4,323,869 4/1982 Minks ..... 335/128
4,398,165 8/1983 Iketani ..... 335/128
4,460,881 7/1984 Meister et al. ..... 335/128
4,567,457 1/1986 Schedele et al. ..... 335/128

*Primary Examiner*—E. A. Goldberg
*Assistant Examiner*—Lincoln Donovan
*Attorney, Agent, or Firm*—Cushman, Darby & Cushman

[57] ABSTRACT

Relay having a coil surrounding a core and an armature connected to at least one moving contact and being held by a spring in contact with a yoke connected to the core and having at least one fixed contact, against which the moving contact can be brought to bear, whereby the spring (4) holding the armature designed essentially as a flat plate and in contact with the yoke is fixedly connected with one end portion to the armature, and with its other end portion to the yoke.

7 Claims, 1 Drawing Sheet

RELAY

BACKGROUND OF THE INVENTION

1. Field of the Art

The invention relates to a relay having a coil surrounding a core and an armature connected to at least one moving contact, said armature being held by a spring in contact with a yoke connected to the core and having at least one fixed contact against which the moving contact can be brought to bear.

2. Background and Prior Art

As a rule, such delays are formed with an essentially L-shaped knife-edge-type armature. However, the disadvantage of this construction is the relatively large size of the armature, which in some cases is only required for the magnetic circuit but which increases the tendency of the relay to bounce.

The object of the invention is to overcome these drawbacks and to set forth a relay which has very simple construction and which achieves a satisfactory result with a minimum of moving masses.

SUMMARY OF THE INVENTION

According to the invention, this object is achieved by fixedly connecting the spring holding the armature designed essentially as a flat plate in contact with the yoke with one end portion to the armature and with its other end portion to the yoke. In this way, it is possible to limit the mass of the armature practically to the mass called for by the requirements of the magnetic circuit. The result being that the masses to be moved during the excitation of the relay and to be braked at the moment of impact of the moving contact with a fixed contact are reduced, thereby diminishing the tendency of the relay to bounce.

According to another aspect, the end portion of the spring held against the yoke may be provided with a cut-out portion, whose boundary face has radial slats or the like and which is traversed by a pin held against the yoke, the narrowed portions of the cut-out portion abutting against said pin, preferably with press fit. This results in a very simple connection of the spirng to the yoke which is easily detachable and can be readily restored. This is particularly advantageous for adjusting purposes.

Furthermore, the area of the spring held against the yoke can be locked in position by at least one other pin connected to the yoke or formed integrally therewith and traversing an appropriate recess of the spring. In this case, afer completion of the adjustment, this pin or pins can be deformed so that removal of the spring from the yoke is no longer possible.

In a preferred practical embodiment of the invention the spring protrudes with one end portion beyond the end portion of the armature which is turned away from the yoke. This end portion of the spring serves as support for the moving contact, resulting in a very simple design.

In this embodiment, it is advantageous for the spring in the area of transition from the armature to the yoke to have at least one reed that presses the armature substantially at right angles against the yoke. Thus it is possible by altering the curvature of the arcuate area of the spring to change the bearing pressure of the contact connected to the spring to a fixed normally closed contact. By bending the area of the spring protruding beyond the armature, it is possible to change the bearing pressure of the contact connected to the spring to a normally open contact. This enables these bearing pressures to be adjusted independently of one another.

During the adjustment, in order to be able to attach the spring to the yoke and to remove it therefrom by means of a simple tool, the yoke, in the area of the recess of the spring which is traversed by the pins held in the yoke, is provided with depressions.

In another preferred embodiment of a relay incorporating the invention, the coil is wound on a coil frame traversed by the core. The coil frame is provided with an arcuate shoulder on which fixed contacts are arranged. The moving contact can be moved between these fixed contacts so that a definite mutual position is ensured between the armature and the contact.

BRIEF DESCRIPTION OF THE DRAWINGS

The invention will now be described with reference to the accompanying drawing, in which.

DETAILED DESCRIPTION OF THE PREFERRED EMBODIMENTS

Figure 1:
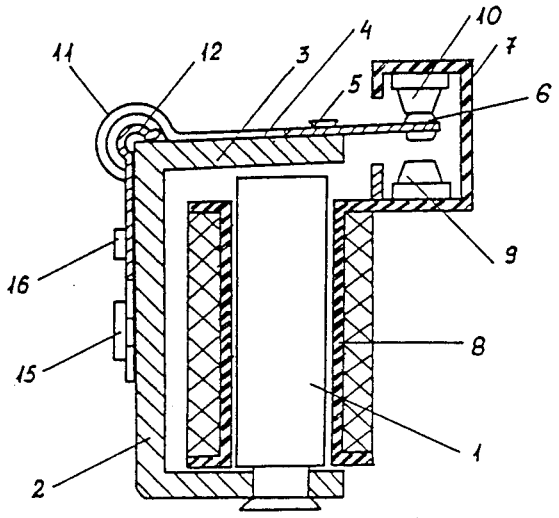
FIG. 1 is a cross-sectional view of a relay of the invention.
Figure 2:
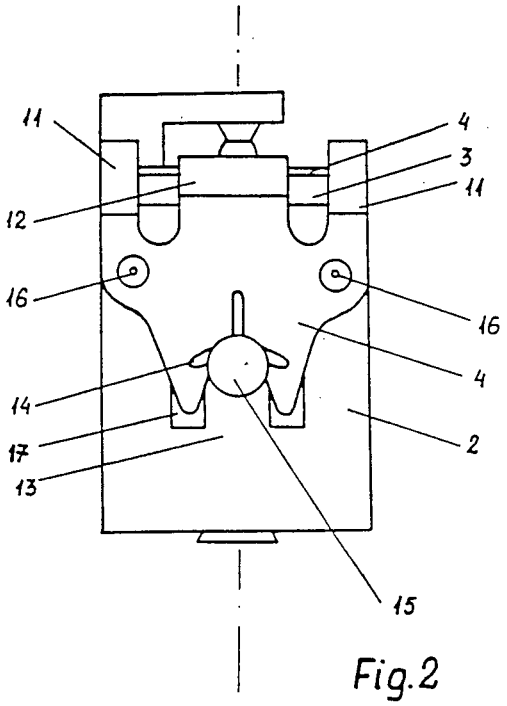
FIG. 2 is a side view of the relay in FIG. 1.

The core (1) is connected to the yoke (2) by rivetting. The armature (3) is connected to a spring (4) by rivetting pins (5).

The spring (4) protrudes with one end beyond the end of the armature (3) turned away from the yoke (2) and supports in this end portion a moving contact (6) which can be moved between the normally open contact (9) and normally closed contact (10) arranged in an arcuate shoulder (7) of the coil frame (8).

The spring (4) has two arcuate areas (11) between which is placed a reed (12) that presses the armature (3) substantially at right angles against the yoke (2).

On its end turned away from the armature (3) the spring (4) is provided with a cut-out portion (13). The bearing face of this cut-out portion (13) has radial slots (14). Radial slots 14 allow the cut-out portion 13 to easily fit around and abut pin 15. This results in the ability to easily remove and replace spring 4 from the yoke 2 and also ensure that spring 4 will stay engaged in the correct position on yoke 4.

To fix the position of the spring (4) on the yoke (2), two pins (16) are provided that traverse the recesses of the spring (4). To adjust the relay by changing the curvature of the arcuate areas (11) and bending the area of the spring (4) protruding beyond the armature (3), the spring (4) may, in certain cases, be removed repeatedly from the yoke (2). After adjustment, the pins (16) are deformed in order to fix the position of the spring.

In order to be able to remove the spring (4) more easily from the pin (15), depressions (17), which facilitate the use of a screw driver or similar tool when removing the spring (4), are provided in the yoke (2) or on its outer surface.

I claim:

1. A relay comprising:

a core;

a coil which surrounds said core;

an armature displaced from one end of said core;

a yoke attached to another end of said core;

a yoke attached to another end of said core and having an end surface upon which rests one end of said armature;

a flat plate spring including:

a first portion connected to said yoke, a second portion connected to said armature, at least one arcuate area interconnecting said first and said second portion, and a reed portion connected to said first portion that presses against said end of said armature substantially at right angles to said yoke which creates a force that is directed normally through said armature in a downward direction onto said end surface of said yoke;

a contact fixed with respect to said yoke; and at least one contact which moves when said armature moves.

2. A relay comprising:

a core;

a coil which surrounds said core;

an armature displaced from one said core;

a yoke attached to another end of said core and disposed adjacent said armature;

a pin attached to said yoke which protrudes from said yoke;

a flat plate spring attached to said armature and removably attached to said yoke, said flat plate spring having a cut-out portion and radial slots extending from said cut-out portion so that said cut-out portion abutting against and engaging said pin to cause said spring to maintain an engaged position on said yoke, said slots facilitating connection and removal of said spring to said yoke;

a contact fixed with respect to said yoke; and at least one contact which moves when said armature moves.

3. The relay according to claim 2 wherein said spring which is removably attached to said yoke is locked in position on said yoke by another pin connected to said yoke.

4. The relay according to claim 7 further including a second fixed contact attached to said curved shoulder in such a way so that said movable contact is located between said fixed contacts.

5. The relay as set forth in claim 2, wherein said spring protrudes beyond the end portion of said armature which is turned away from said yoke so that said spring supports said at least one moving contact.

6. The relay as set forth in claim 2, wherein said yoke in the area of said cut-out portion of said spring which is traversed by said pin held in said yoke, is provided with depressions which allow the entry of a simple tool behind said spring so that said spring can be easily removed.

7. The relay as set forth in claim 2. wherein said coil is wound on a coil frame and said coil frame is provided with a curved shoulder on which said fixed contact between is attached.

* * * * *